US005346405A

United States Patent [19]

Mosser, III et al.

[11] Patent Number: 5,346,405

[45] Date of Patent: Sep. 13, 1994

[54] SHUNTED CONNECTOR ASSEMBLY AND SHUNT ASSEMBLY THEREFOR

[75] Inventors: Benjamin H. Mosser, III, Middletown; Robert H. Frantz, Newville; Lynn R. Sipe, Lewistown, all of Pa.

[73] Assignee: The Whitaker Corporation, Wilmington, Del.

[21] Appl. No.: 58,555

[22] Filed: May 4, 1993

[51] Int. Cl.[5] ..... H01R 25/00

[52] U.S. Cl. ..... 439/188

[58] Field of Search ..... 439/188

[56] References Cited

U.S. PATENT DOCUMENTS

| | | | |
|---|---|---|---|
| 3,860,316 | 1/1975 | Hardesty | 339/91 R |
| 3,903,385 | 9/1975 | Moyer et al. | 200/51.1 |
| 4,221,458 | 9/1980 | Hughes et al. | 339/126 R |
| 4,457,575 | 7/1984 | Davis et al. | 339/143 R |
| 4,744,769 | 5/1988 | Grabbe et al. | 439/284 |
| 4,781,626 | 11/1988 | Lazarchik | 439/680 |
| 4,952,170 | 8/1990 | Pritulsky | 439/509 |
| 5,041,017 | 8/1991 | Nakazato et al. | 439/509 |
| 5,190,464 | 3/1993 | Chow et al. | 439/188 |

*Primary Examiner*—Eugene F. Desmond

[57] ABSTRACT

A shunted connector assembly (14) wherein the electrical connector (12) has a housing (22) with spaced contacts (18), each having an exposed contact portion along an open portion of a side wall (30) of the housing. A shell member (64) is mounted to the connector housing and a shunt contact support housing (66) is slidably mounted to the shell member. The shunt contact support housing is movable generally linearly between first and second positions. When the shunt contact support housing is in the first position, shunt contacts (68, 70) secured therein engage pairs of spaced contacts (18) of the connector. When the shunt contact support housing is in the second position, the shunt contacts are electrically isolated from the connector contacts. A spring (72) biases the shunt contact support housing toward its first position so that when the connector is disengaged from a mating receptacle connector (36), the shunt contact support housing is automatically moved to the first position wherein connector contact pairs are electrically commoned. When the electrical connector is mated with a receptacle connector, the shunt contact support housing comes into interfering engagement with structure (58) surrounding the recess (176) of the receptacle connector so that the shunt contact support housing is moved to the second position. During movement of the shunt contact support housing from its first position toward its second position, it is lifted away from the electrical connector so that the shunt contacts do not rub against the connector.

11 Claims, 7 Drawing Sheets

SHUNTED CONNECTOR ASSEMBLY AND SHUNT ASSEMBLY THEREFOR

BACKGROUND OF THE INVENTION

This invention relates to electrically shunting contacts in an unmated electrical connector and, more particularly, to a shunt assembly for use with an electrical connector or an electrical connector incorporating the shunt assembly wherein, upon disengaging the connector from a complementary mating receptacle connector, the shunt assembly is self-biased to engage contacts of the unmated connector so as to electrically common predetermined ones of the connector contacts, and upon mating the connector with the complementary mating receptacle connector the shunt assembly automatically disengages from the connector contacts.

When a connector having a cable extending to a computer system is disconnected from a receptacle connector in a peripheral device, predetermined ones of the conductors of the disconnected cable must be electrically commoned within a limited time of being disconnected so as to prevent the computer system from powering down. This has traditionally been achieved by providing a complementary receptacle connector, mounted on a printed circuit board, for mating with the disconnected connector upon being disconnected from the peripheral device. Traces on the circuit board electrically common appropriate contacts of the printed circuit board receptacle connector and thus the corresponding cable conductors. As computers become faster and faster, the available time to achieve electrical commoning of the conductors of the disconnected cable has been significantly decreased.

It would be desirable to have a shunt assembly which automatically provides electrical commoning of appropriate conductors of a cable upon the disconnection of the cable connector from a receptacle connector of a peripheral device.

U.S. Pat. No. 4,952,170 discloses one such assembly wherein the shunt contacts are supported in a housing which is pivotally mounted on the connector. The housing is spring biased in a direction wherein the shunt contacts common the appropriate connector contacts when the connector is disengaged. However, when mating the connector with a receptacle connector, the shunt contact housing must first be pivoted away from the connector contacts. While effective, the arrangement disclosed in the referenced patent is disadvantageous in two respects—first, it requires user manipulation to pivot the shunt contacts into an inoperative position when the connector is mated and, second, relatively large spacing between receptacle connectors is required to provide room to pivot the shunt contact housing. There are many environments where space is at a premium, so that there is insufficient space to allow for pivoting of the shunt contact housing and also there is insufficient space for a user's fingers to manipulate the housing.

It is therefore an object of the present invention to provide a shunt assembly for a connector which does not require user manipulation to make the shunt assembly either operative or inoperative, but instead functions automatically upon engagement and disengagement with a complementary mating receptacle connector.

It is another object of this invention to provide such a shunt assembly with a minimum space requirement between receptacle connectors.

SUMMARY OF THE INVENTION

The foregoing, and additional, objects are attained in accordance with the principles of this invention by providing a shunt assembly of the type described wherein the shunt contacts are secured in a housing which is slidably mounted relative to the connector. The housing is movable between a first position and a second position. When the housing is in the first position, the shunt contacts common appropriate ones of the connector contacts. When the housing is in the second position, the shunt contacts are electrically isolated from the connector contacts. Bias means are provided to yieldably bias the housing toward the first position. Accordingly, when the electrical connector is mated with a complementary receptacle connector the shunt contact housing is automatically moved from the first position to the second position against the force of the bias means and when the electrical connector is disengaged from the complementary receptacle connector the bias means moves the shunt contact housing from the second position to the first position so that the connector contacts are appropriately commoned.

In accordance with an aspect of this invention, the shunt contacts are transversely separated from the connector housing during movement of the shunt contact housing to eliminate frictional engagement between the shunt contacts and the connector housing.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
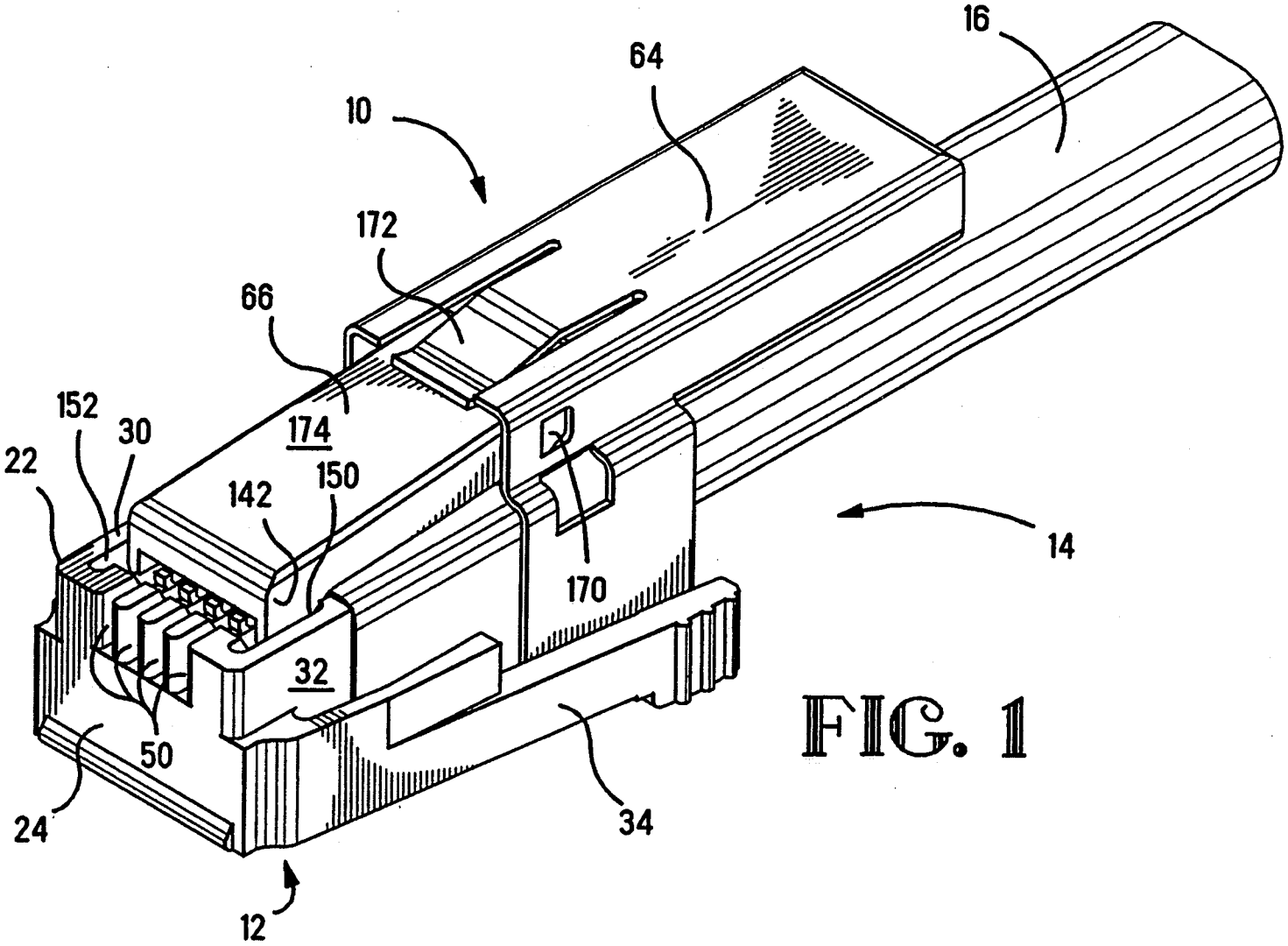
FIG. 1 is a perspective view of a shunt assembly in accordance with the present invention secured to a connector resulting in a shunted connector assembly in accordance with the present invention.

The drawings illustrate a shunt assembly, designated generally by the reference numeral 10, according to the present invention, secured to a plug connector, designated generally by the reference numeral 12, resulting in a shunted connector assembly, designated generally by the reference numeral 14. The plug connector 12 terminates a multi-conductor cable 16 and illustratively provides four spaced contacts 18, each terminating a respective one of the four conductors 20 of the cable 16. The plug connector 12 is preferably generally of the type disclosed in the referenced U.S. Pat. No. 4,952,170 and includes an insulating housing 22 having a mating end 24, a rearward end 26, upper and lower housing side walls 28, 30, and oppositely facing housing end walls 32. Resilient latch arms 34 extend from the housing end walls 32 for engaging the mating receptacle connector 36, as is well known in the art.

A cable receiving opening 38 extends into the rearward end 26 of the housing 22 and has the cable 16 inserted therein. The conductors 20 of the cable 16 extend into a reduced cross-section forward portion 40 of the opening 38, the cable 16 being retained by an integral strain relief clamp 42 formed in the recess 44 of the upper housing side wall 30. The conductors 20 are retained by conductor strain relief means 46 formed in the recess 48. The contacts 18 are received in the recesses 50 which extend inwardly from the mating end 24 as well as inwardly from the upper side wall 30. Illustratively, the contacts 18 are of the insulation piercing type which electrically engage the individual conductors 20 of the cable 16. When the plug connector 12 is mated with the receptacle connector 36, the contacts 18 engage cantilever spring receptacle contacts 52 in the receptacle connector 36. The contacts 52 complete a plurality of circuits to the printed circuit board 54 within the panel 56.

Figure 2:
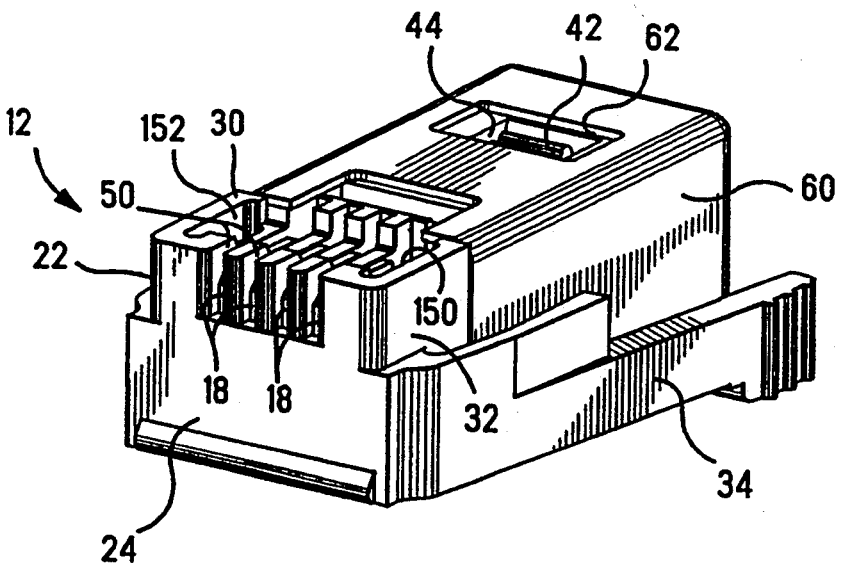
FIG. 2 is a perspective view of the electrical connector shown in FIG. 1 to which the shunt assembly according to this invention may be secured.
Figure 3:
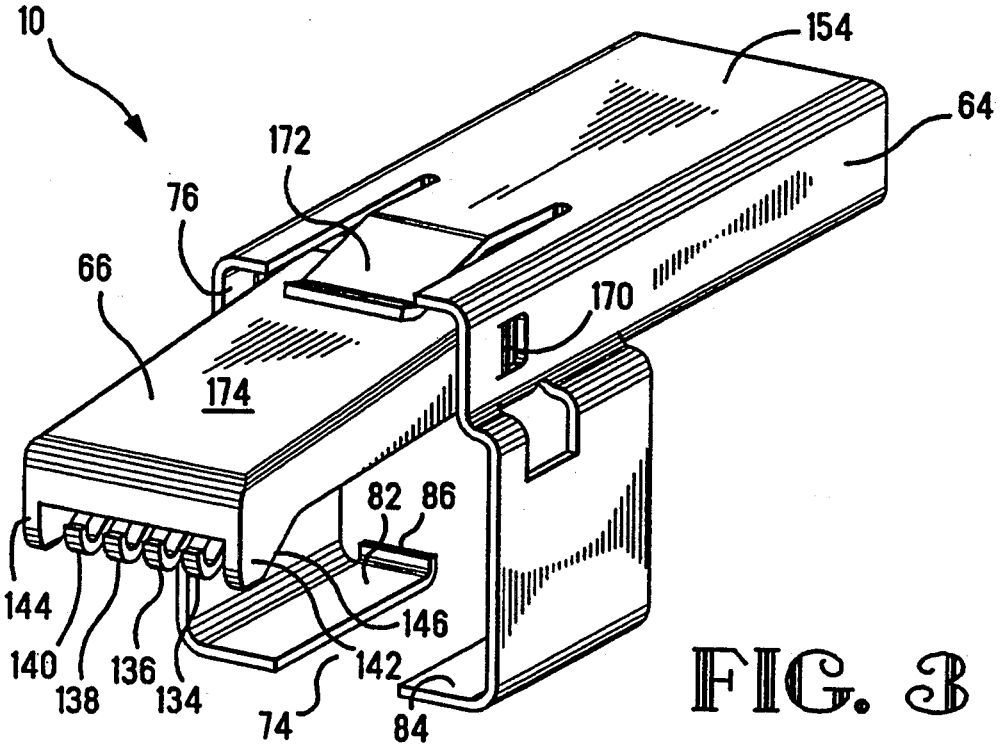
FIG. 3 is a perspective view of a shunt assembly according to this invention.
Figure 4:
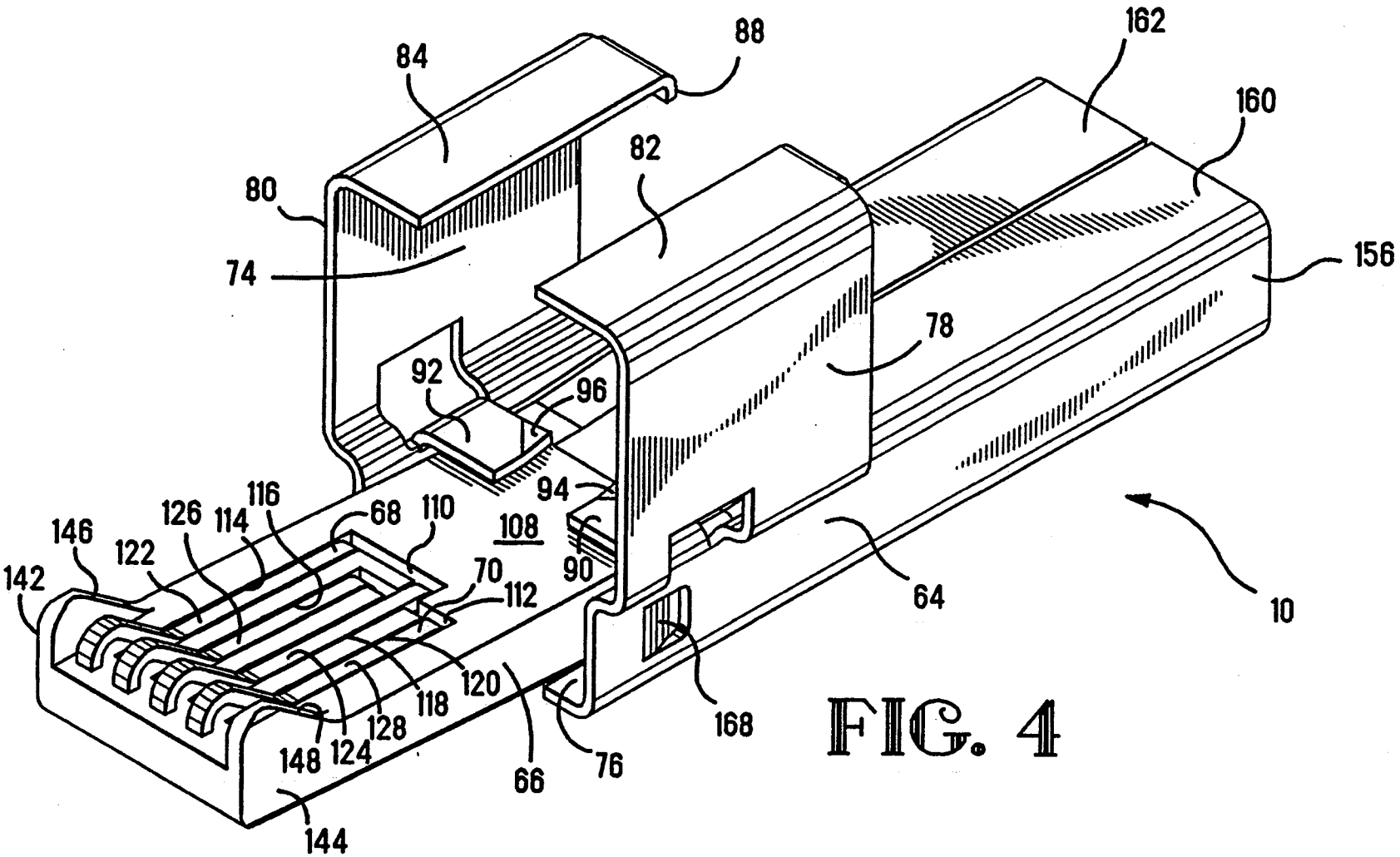
FIG. 4 is a perspective view of the inner surface of the shunt assembly of FIG. 3.
Figure 5:
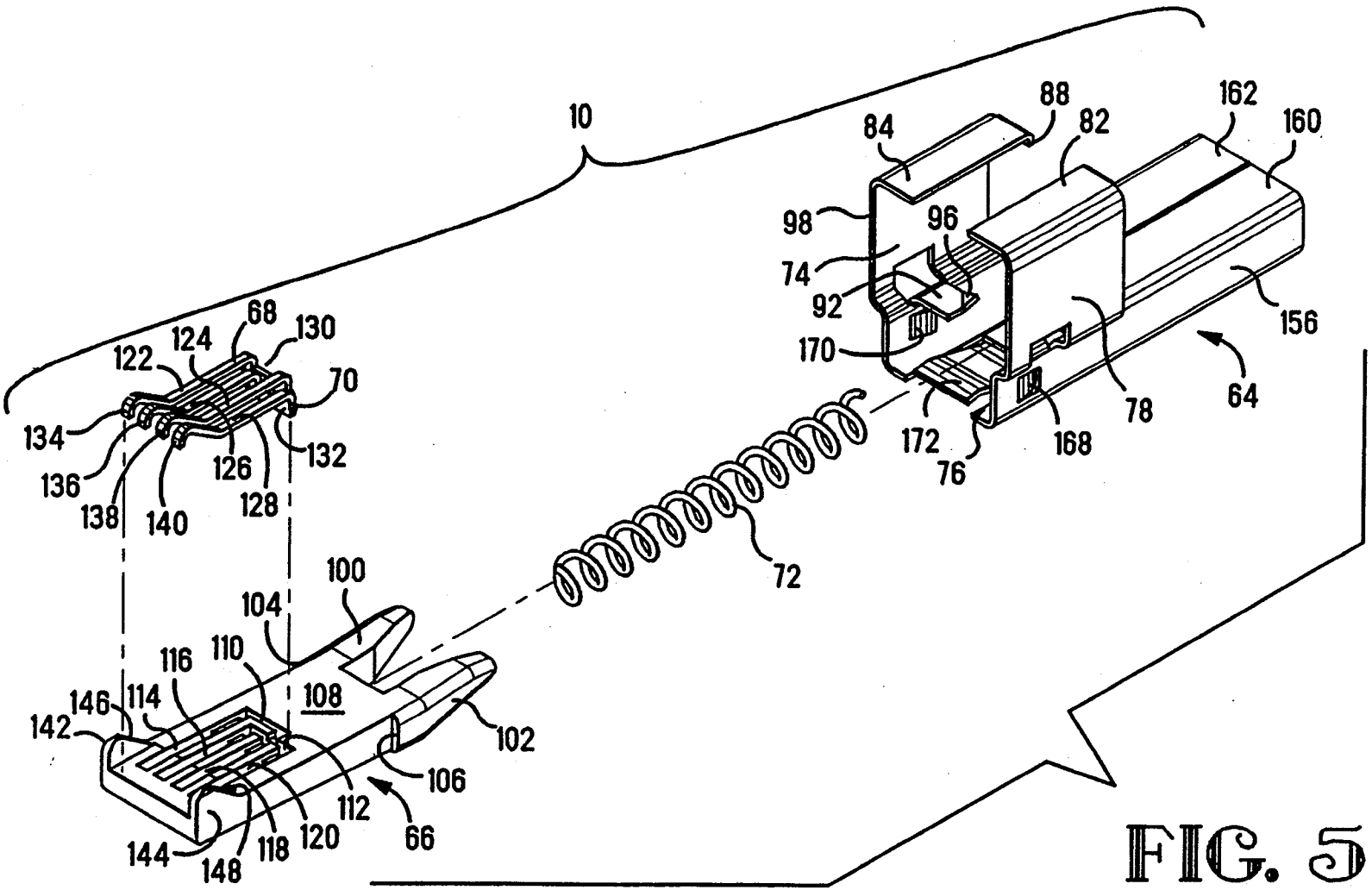
FIG. 5 is an exploded perspective view of the shunt assembly shown in FIG. 4.
Figure 6:
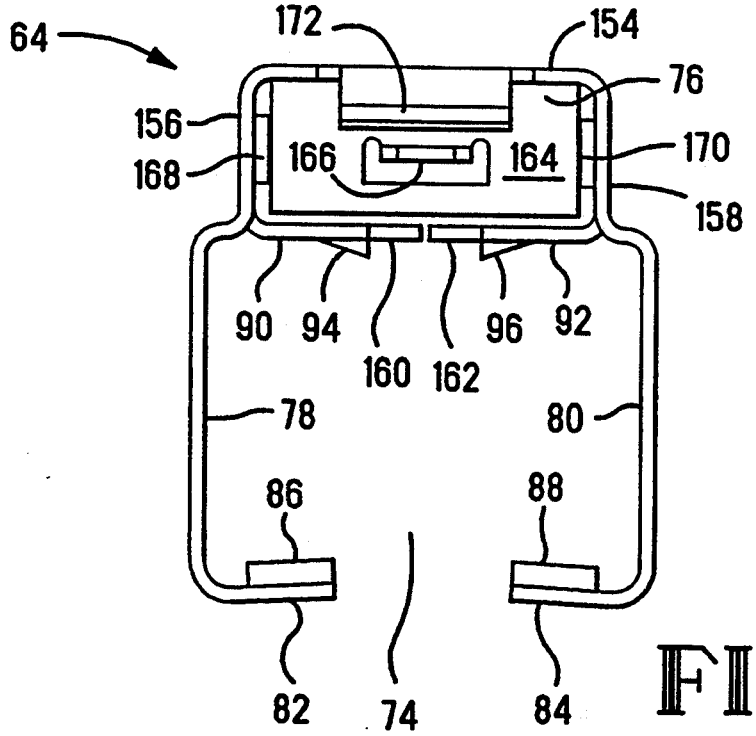
FIG. 6 ms an end view of the shell member of the shunt assembly according to this invention.
Figure 7:
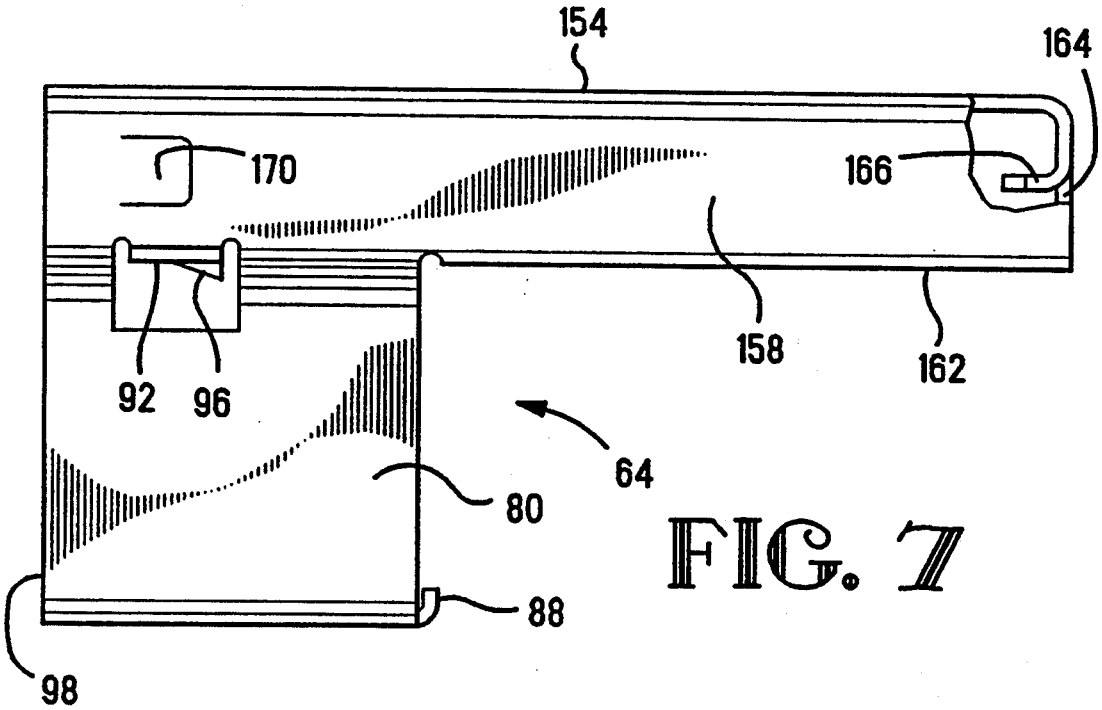
FIG. 7 is a side view, partially broken away, of the shell member shown in FIG. 6.

The receptacle connector 36 is typically shielded at 58, which shielding 58 engages the shielding 60 surrounding the connector housing 22. As best shown in FIG. 2, the shielding 60 is formed with an open window 62 which exposes the recess 44. Further, the shielding 60 leaves the recesses 50 exposed so that when the plug connector 12 is mated with the complementary receptacle connector 36, the receptacle contacts 52 can extend into the open sides of the recesses 50 to engage the exposed contact portions of the respective connector contacts 18. As best seen in the exploded perspective view of FIG. 5, the shunt assembly 10 includes the shell member 64, the contact support housing 66, the shunt contacts 68, 70 and the helical compression spring 72. In the preferred embodiment, the shell member 64 is stamped and formed from metal sheet stock so as to have two channels, but could also be a molded plastic member providing the same functions. The first channel 74 of the shell member 64 is for the purpose of receiving therein the plug connector 12. The second channel 76 is for the purpose of receiving therein the contact support housing 66 and the spring 72.

As shown, the shell member 64 includes generally parallel opposed side walls 78, 80 for the first channel 74 which engage housing end walls 32 of the plug connector 12 when the shell member 64 is mounted thereon. Bottom walls 82, 84 extend respectively from the side walls 78, 80, each toward the opposite side wall. The inner surfaces of the bottom walls 82, 84 engage the side wall 28 of the plug connector 12 when the shell member 64 is mounted thereon. Extensions 86, 88 of the bottom walls 82, 84, respectively, are bent upwardly toward the first channel 74 to provide stops which engage the rearward end 26 of the plug connector 12. Portions of the side walls 78, 80 are cut and bent to form the top walls 90, 92 of the first channel 74 which engage the side wall 30 of the plug connector 12. Corners 94 and 96 of the top walls 90 and 92, respectively, are bent slightly so as to extend into the first channel 74. Accordingly, for mounting of the shell member 64 to the plug connector 12, the forward end 98 of the shell member 64 is slipped over the rearward end 26 of the plug connector 12 and is moved thereover until the rearward end 26 of the plug connector 12 abuts the stops 86, 88. At the same time, the corners 94 and 96 ride on the shielding 60 and cause the top walls 90 and 92 to flex away from the plug connector 12. The parts are so dimensioned that when the rearward end 26 of the plug connector 12 reaches the stops 86, 88 the bent corners 94 and 96 enter the window 62 of the shielding 60 so as to provide stops which prevent subsequent removal of the plug connector 12 from the first channel 74.

The contact support housing 66 is molded of insulative material and has a generally flat box-like shaped body portion with a pair of spaced legs 100, 102 extending from the rearward end thereof. The legs 100, 102 are terminated at their proximal ends by oppositely directed lateral shoulders 104, 106, respectively, the purpose of which will be described hereinafter. At the forward end of the housing 66, the inner surface 108 has transverse channels 110, 112 and axial channels 114, 116, 118, 120 recessed from the inner surface 108 for receiving the contacts 68 and 70, in the same manner as disclosed in the referenced U.S. Pat. No. 4,952,170. The axial channels 114, 116, 118, 120 are spaced across the inner surface 108 to correspond in position and number to the connector contacts 18. The axial channels 114 and 118 intersect the transverse channel 110 and receive the shunt contact 68 with cantilever arms 122 and 124, respectively, therein. Similarly, the axial channels 116 and 120 intersect the transverse channel 112 and receive the shunt contact 70 with cantilever arms 126 and 128, respectively, therein. The contacts shunt 68 and 70 are substantially identical, except for the lengths of their respective cantilever arms. Each of the shunt contacts 68, 70 has a bridging body member 130, 132, respectively, from which the respective cantilever arms depend. The bridging body members 130, 132 are received in the transverse channels 110, 112, respectively. Each of the cantilever arms 122, 124, 126, 128 is formed with a respective arcuate bent portion 134, 136, 138, 140 to engage respective connector contacts 18. Although not shown in full detail herein, but as disclosed in the referenced U.S. Pat. No. 4,952,170, each of the bridging body members 130, 132 is preferably formed with a stabilizing protrusion and a barb for securing the shunt contacts 68, 70 in their respective channels.

At the forward end of the body portion of the shunt contact housing 66, and formed integrally therewith, are a pair of body portions, or flanges, 142, 144 which are adjacent to and flank the channels 114, 116, 118, 120. The flanges 142, 144 extend transversely away from the inner surface 108. As will be described in full detail hereinafter, the flanges 142, 144 are formed with cam surfaces 146, 148, respectively, and cooperate with the recesses 150, 152, respectively, which are formed in the connector housing 22. The recesses 150, 152 extend into the connector housing 22 from the side wall 30 thereof and flank the recesses 50 in which the connector contacts 18 are disposed.

To hold the shunt contact housing 66, as previously mentioned the shell member 64 is formed with the second channel 76 defined by the top wall 154, depending side walls 156, 158 and bottom walls 160, 162. At its rearward end, the top wall 154 is bent to form a rear wall 164, a portion of which is cut and bent to form a tab 166 which extends forwardly into the second channel 76. Further, the side walls 156, 158 are each cut in a horizontal U-shape and bent inwardly to form resilient one way stops 168, 170, respectively. When the shunt assembly 10 is assembled, the spring 72 is inserted into the second channel 76 so that the tab 166 enters a first end thereof to prevent lateral movement of the spring 72. The other end of the spring 72 goes between the legs 100, 102 of the shunt contact support housing 66 and the housing 66 is then inserted into the second channel 76 from the forward 98 of the shell member 64. During this insertion, the stops 168, 170 are flexed outwardly until the shoulders 104, 106 pass thereby. The stops 168, 170 then snap back inwardly to prevent subsequent removal of the housing 66 by means of interference with the shoulders 104, 106.

The top wall 154 is cut and bent at its forward end to form an integral spring finger 172 which bears against the outer surface 174 of the housing 66.

Figure 8:
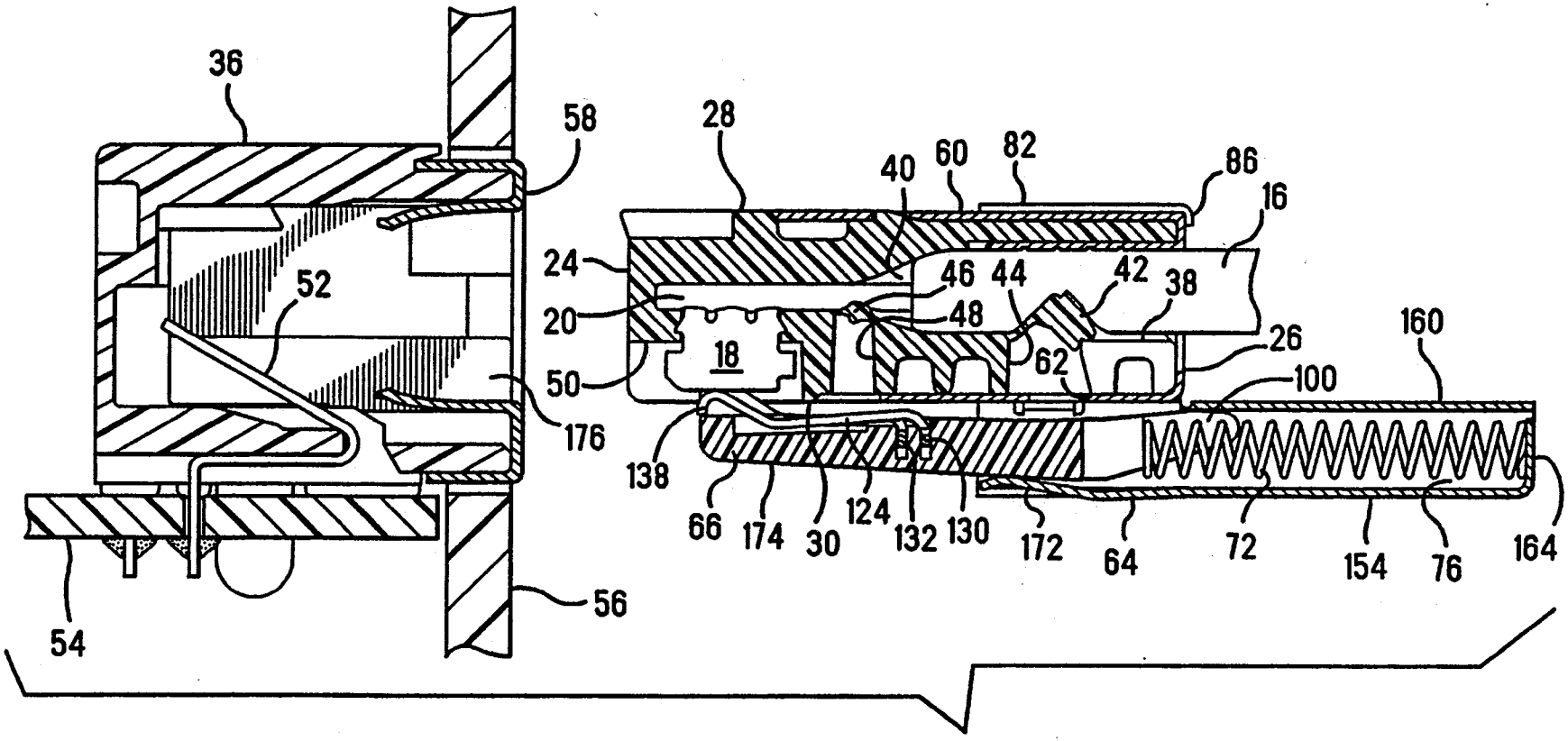
FIG. 8 is a cross sectional view of a shunted connector assembly according to this invention positioned to be mated with a complementary receptacle connector.

As best seen in FIGS. 1 and 8, with the plug connector 12 in an unmated, or disengaged, condition, the spring 72 biases the shunt contact support housing 66 outwardly from the second channel 76 into an extended, or first, position where the shunt contacts 68, 70 engage the contacts 18 so as to electrically common appropriate conductors 20 of the cable 16. With the housing 66 in its first position, the flanges 142, 144 are received in the recesses 150, 152 of the connector housing 22. The recesses 150, 152 have sufficient depth to fully receive the flanges 142, 144 and allow the arcuate portions 134, 136, 138, 140 of the shunt contacts 68, 70 to engage the exposed connector contacts 18. The spring 72 provides a force to yieldably bias the housing 66 to its first position and the spring finger 172 provides a force to transversely bias the housing 66 so that the shunt contacts 68, 70 engage the contacts 18. It is noted that the spring 72 must be selected to provide a force sufficient to overcome the frictional force provided by the spring finger 172 against the outer surface 174 of the housing 66 in order to move the housing 66 to its first position from its retracted position, which will be described hereinafter.

Figure 9:
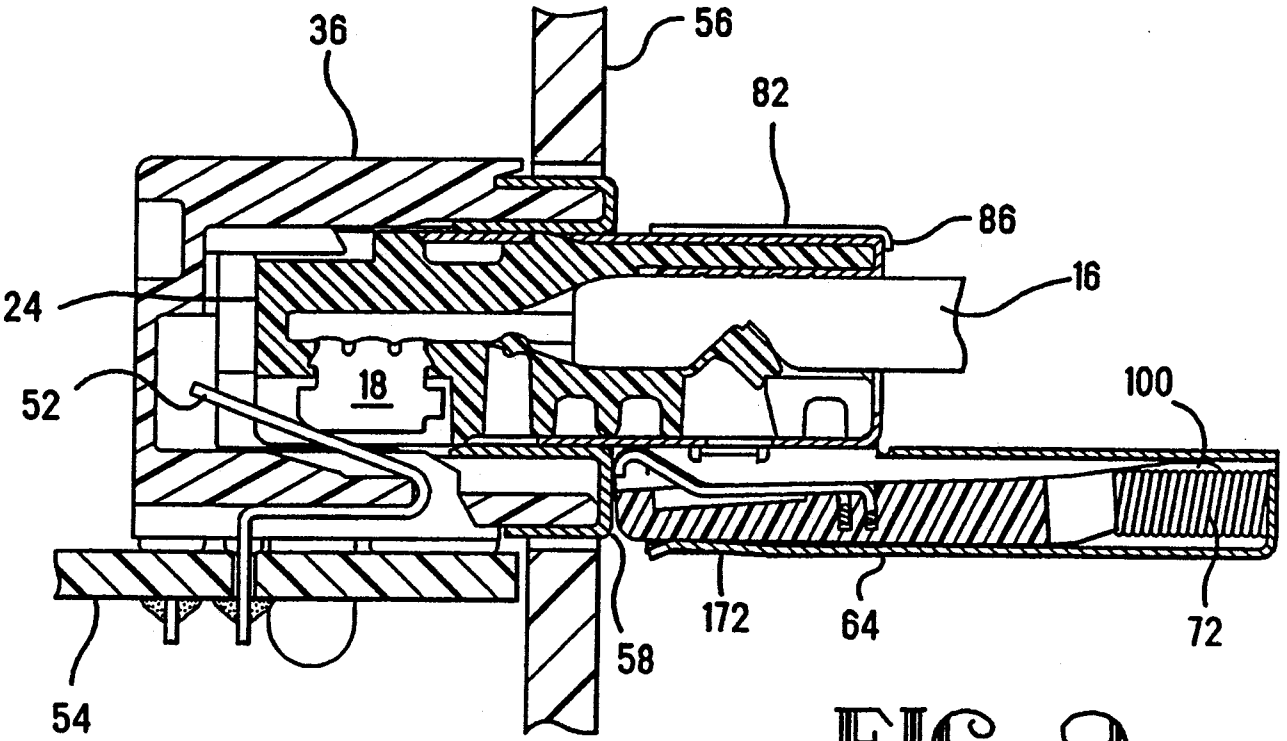
FIG. 9 is a cross sectional view similar to FIG. 8 showing the shunted connector assembly mated with the receptacle connector.

When the connector 12 is mated with the receptacle connector 36, the mating end 24 of the connector housing 22 is inserted into the recess 176 of the receptacle connector 36. As the connector housing 22 extends into the receptacle recess 176, the forward end of the shunt contact support housing 66 comes into interfering engagement with the shielding 58 which surrounds the opening to the recess 176. Further movement of the connector housing 22 into the recess 176 causes the shunt contact support housing 66 to be moved from its extended position against the biasing force of the spring 72 to a retracted, or second, position within the second channel 76, as best shown in FIG. 9. With the contact support housing 66 in its retracted position, the shunt contacts 68, 70 are electrically isolated from the connector contacts 18.

During movement of the shunt contact support housing 66 from its first position to its second position, the cam surfaces 146, 148 of the flanges 142, 144 cooperate with the rear walls of the recesses 150, 152 so as to move the shunt contact support housing 66 transversely away from the side wall 30 of the plug connector 12. The flanges 142, 144 are of sufficient dimension that they extend away from the inner surface 108 of the shunt contact support housing 66 a greater distance than the arcuate portions 134, 136, 138, 140 of the shunt contacts 68, 70. Accordingly, arcuate portions 134, 136, 138, 140 of the shunt contacts 68, 70 are kept out of engagement with the plug connector 12, thereby preventing friction therebetween which would otherwise adversely affect the surfaces of the arcuate portions 134, 136, 138, 140, which are conventionally gold plated.

When the plug connector 12 is disengaged from the receptacle connector 36, as the connector 12 exits the receptacle recess 176, the force generated by the compression spring 72 overcomes the frictional force on the housing 66 provided by the spring finger 172 and causes the housing 66 to move from its retracted position to its extended position, where the arcuate portions 134, 136, 138, 140 of the shunt contacts 68, 70 engage the contacts 18 to electrically common appropriate ones of the conductors 20 of the cable 16. During this movement of the shunt contact housing 66 from its retracted position to its extended position the flanges 142, 144 maintain the desired clearance between the arcuate portions 134, 136, 138, 140 of the shunt contacts 68, 70 and the connector 12.

It is noted that the movement of the shunt contact support housing 66 is generally linear, with the central axis of the helical compression spring 72 being generally along the line of movement of the housing 66, thereby resulting in a simple construction with repeatable automatic self-actuated movement of the housing 66.

Accordingly, there has been disclosed an improved shunted connector assembly and shunt assembly therefor which provides automatic operation without requiring user manipulation to either engage or disengage the shunt contacts. Further, the design is compact with no transverse enlargement of the assembly during either engagement or disengagement with a complementary receptacle connector. While an illustrative embodiment of the present invention has been disclosed herein, it is understood that various modifications and adaptations to the disclosed embodiment will be apparent to those or ordinary skill in the art and it is only intended that this invention be limited by the scope of the appended claims.

What is claimed is:

1. A shunt assembly for shorting electrical contacts of an electrical connector comprising:

an insulative contact support member on an electrical connector, an electrical shunt contact supported on the support member, a shell member receiving the connector and the support member, a spring biasing the support member toward a first position alongside a mating end of the connector with the shunt contact in engagement with selected electrical contacts on the connector, the support member being urged to a second position by movement of the mating end into engagement with another, mating electrical connector, with the shunt contact being disengaged from the selected electrical contacts, and at least one cam surface on the support member engaging the connector during said movement of the support member, said cam surface biasing the support member outward relative to the connector to separate the shunt contact from the connector without frictional engagement therebetween.

2. A shunt assembly as recited in claim 1, and further comprising: a second spring on the shell member biasing the shunt contact toward the selected contacts.

3. A shunt assembly as recited in claim 1 wherein, the cam surface comprises a projecting surface on the support member beside the shunt contact.

4. A shunt assembly as recited in claim 1 and further comprising: a second spring engaged against the support member to bias the shunt contact toward the selected contacts.

5. A shunt assembly as recited in claim 1 and further comprising: a second spring on the shunt assembly biasing the shunt contact toward the selected contacts.

6. A shunt assembly as recited in claim 1, and further comprising: a spring finger formed on the shell member biasing the support member and the shunt contact toward the selected contacts.

7. A shunt assembly as recited in claim 1, and further comprising: the spring being received inside the shell member, the support member projecting outward of a forward end of the shell member, and the support member being slidable inside the shell member.

8. A shunt assembly for shorting electrical contacts of an electrical connector comprising:

an insulative contact support member on an electrical connector, an electrical shunt contact supported on the support member, a shell member receiving the connector and the support member, a spring biasing the support member toward a first position alongside a mating end of the connector with the shunt contact in engagement with selected electrical contacts on the connector, the support member being urged to a second position by movement of the mating end into engagement with another, mating electrical connector, with the shunt contact being disengaged from the selected electrical contacts, and a second spring on the shell member biasing the shunt contact toward the selected contacts.

9. A shunt assembly as recited in claim 8 and further comprising: the second spring being engaged against the support member to bias the shunt contact toward the selected contacts.

10. A shunt assembly as recited in claim 8 wherein, the second spring comprises, a spring finger formed on the shell member biasing the support member and the shunt contact toward the selected contacts.

11. A shunt assembly as recited in claim 8, and further comprising: the spring being inside the shell member, the support member being received slidably inside the shell member and projecting outward of a forward end of the shell member to the first position.

* * * * *